United States Patent [19]

Fuehrer

[11] Patent Number: 4,946,210

[45] Date of Patent: Aug. 7, 1990

[54] TAMPER RESISTANT SHACKLE SEAL

[75] Inventor: Charles Fuehrer, Scarsdale, N.Y.

[73] Assignee: Stoffel Seals Corporation, Nyack, N.Y.

[21] Appl. No.: 209,056

[22] Filed: Jun. 20, 1988

[51] Int. Cl.[5] ..... B65D 33/34

[52] U.S. Cl. ..... 292/318; 292/DIG. 60

[58] Field of Search ..... 292/318, 320, 321, 307, 292/319, 322, DIG. 60

[56] References Cited

U.S. PATENT DOCUMENTS

| | | | |
|---|---|---|---|
| 1,850,825 | 3/1932 | Borland | 292/322 |
| 2,033,371 | 3/1936 | Benaggia | 292/327 X |
| 3,466,077 | 9/1969 | Moberg | 292/322 |
| 3,556,575 | 1/1971 | Farkas | 292/318 X |
| 3,600,027 | 8/1971 | Noland | 292/322 |
| 3,712,655 | 1/1973 | Fuehrer | 292/321 |
| 3,954,295 | 5/1976 | Harley | 292/319 |
| 4,001,919 | 1/1977 | Moberg et al. | 292/318 X |
| 4,059,300 | 11/1977 | Moberg et al. | 292/322 |
| 4,229,031 | 10/1980 | Guiler | 292/322 |
| 4,319,776 | 3/1982 | Moberg | 292/322 |
| 4,502,305 | 3/1985 | Bakker | 292/320 X |
| 4,559,676 | 12/1985 | Paradis | 24/16 PB |
| 4,609,218 | 9/1986 | Chevillard et al. | 292/320 |
| 4,621,230 | 11/1986 | Crouch et al. | 292/321 X |
| 4,680,836 | 7/1987 | Wisecup | 292/322 X |

FOREIGN PATENT DOCUMENTS

| | | |
|---|---|---|
| 2342681 | 3/1974 | Fed. Rep. of Germany . |
| 1430093 | 3/1976 | United Kingdom . |

*Primary Examiner*—Richard E. Moore

*Attorney, Agent, or Firm*—Dowell & Dowell

[57] ABSTRACT

A shackle seal housing has a separate plug that is snugly received in its entirety within one end of the housing, the housing having an inwardly extending circumferential ridge and the plug having a groove in its outer wall which receives the ridge when the plug is seated. The inner end of the plug has a cavity which snugly receives the shackle end thereby preventing inward compression of the plug when it is seated within the housing. The housing may have a non-circular configuration, to prevent twisting of the shackle within the housing. The shackle strap may have a variable width border provided by an opening to permit selection of its breaking strength.

9 Claims, 1 Drawing Sheet

FIG. 1
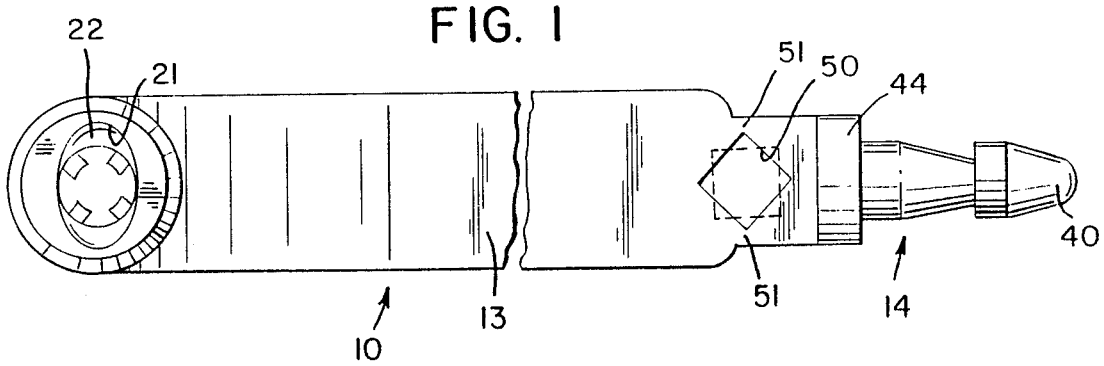
FIG. 2
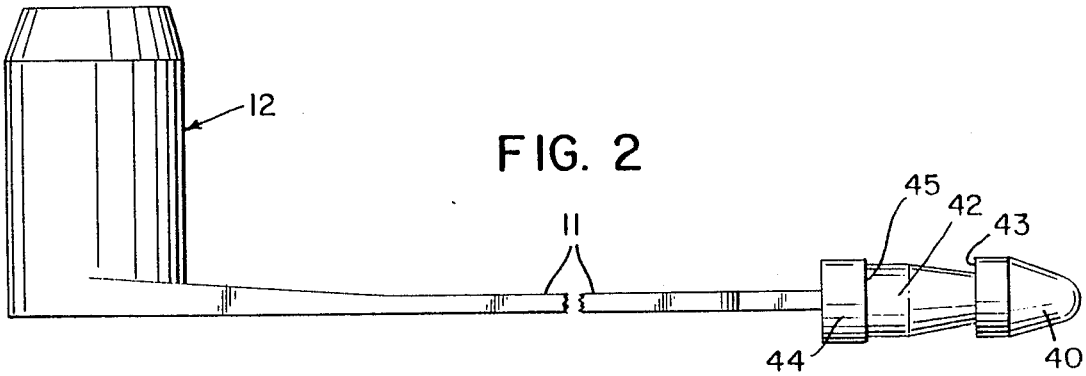
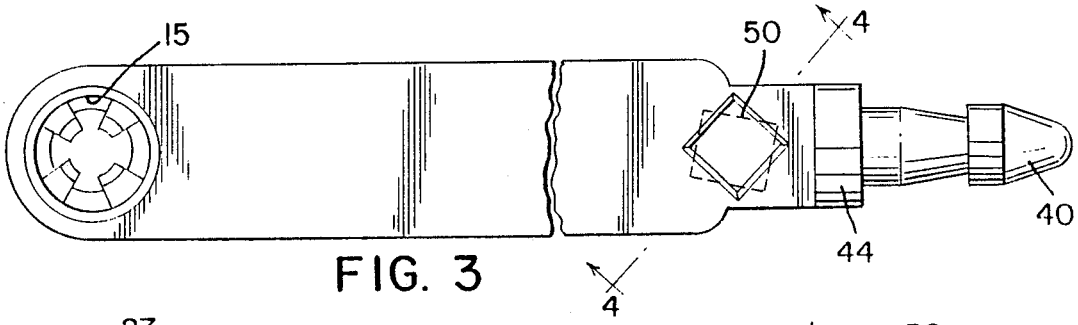
FIG. 3
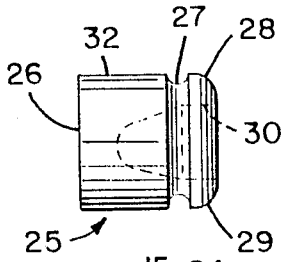
FIG. 5
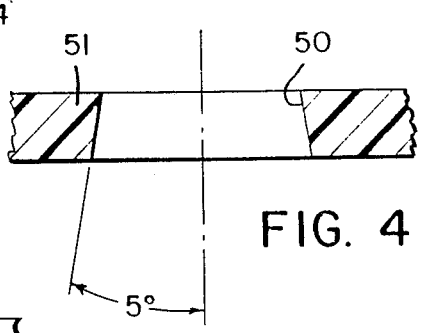
FIG. 4
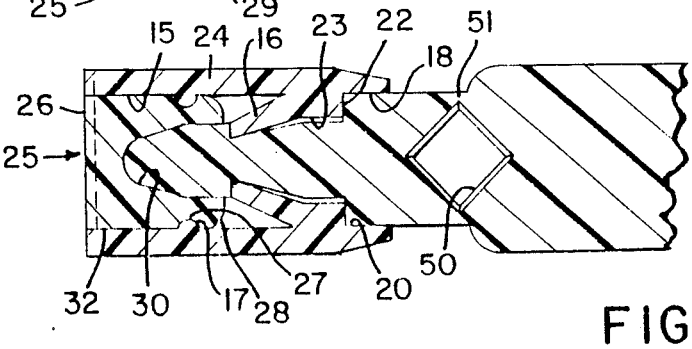
FIG. 6

TAMPER RESISTANT SHACKLE SEAL

BACKGROUND OF THE INVENTION

1. Field of the Invention

This invention relates to seals, and more particularly, to security seals of the type that have a housing connected to a strap member having an end which is received within the housing and locked therein. The primary purpose of the seal is to prevent unauthorized opening thereof by any means which would not be readily detectable.

2. Description of the Prior Art

Shackle seals have become well-developed over the years. They are in wide-spread use for security sealing the doors in cargo trucks and the like. Among the requirements for them are that they be easy to use, that they function adequately and that they be inexpensive. The one-piece plastic seal has become the shackle seal of choice in most instances. Such seals are easy to stock, non-corrodible, easy to place in service, and easy for the authorized person to break and dispose of at the appropriate time.

Since truck cargos are valuable and subject to pilferage, such seals must be strong enough to withstand ordinary handling and not subject to inadvertent breakage. Of special importance is that their structure be such that they may not be opened and reclosed without evidence of such opening being apparent.

The use of a shackle housing having internal spring fingers which engage the end portion of the shackle has become well known. In order for such housing to be secure against tampering, it is necessary that both of its ends be closed to prevent the insertion of a pointed, manipulating instrument. Due to the internal structure of the housing, it is not economically feasible to manufacture the same with one of its ends closed.

Attempts have been made to provide a closure for the end of the housing by an added step of molding over an end portion following the initial molding. Examples are shown in Moberg et al. U.S. Pat. Nos. 4,059,300 and 3,466,077.

A plug connected to a tab on the housing is disclosed in Harley U.S. Pat. No. 3,954,295.

The Guilar U.S. Pat. No. 4,229,031 discloses a plug for a housing in which the plug has a pair of legs which compress inwardly when the plug is inserted into the housing. The Moberg U.S. Pat. No. 4,319,776 is somewhat similar.

Another example of a cap member for a plug is disclosed in Chevillard et al. U.S. Pat. No. 4,609,218.

The Fuehrer U.S. Pat. No. 3,712,655 discloses a shackle seal having indentations in the strap to provide an appropriate level of breaking. The patent to Harley, above mentioned, also discloses an opening 50 in its strap for the purpose of facilitating breakage and an oval base in its housing to prevent rotation of the end portion 12.

The Paradis U.S. Pat. No. 4,559,676 discloses a tip member for a shackle seal which has a portion that is compressed when it is inserted into the locking head.

SUMMARY OF THE INVENTION

It is an object of the present invention to provide a shackle seal having a housing and plug whose configuration is such that there are no significant areas of weakness in the housing or plug due to their configuration and which can be manufactured inexpensively.

It is a further object of the invention to provide an improved shackle seal which provides maximum resistance to tampering.

It is a further object to provide a shackle seal in which the breaking strength of the connecting strap may be readily incorporated into the product in accordance with customer preference.

BRIEF DESCRIPTION OF THE DRAWINGS

These and other objects of the invention will become apparent from the following description in conjunction with the accompanying drawing in which:

FIG. 1 is a top plan view of a preferred embodiment, prior to insertion of the plug, in which the orientation of the opening 50 to provide a maximum border is indicated in phantom.

FIG. 2 is a side elevation.

FIG. 3 is a bottom plan view in which the opening orientation to provide a border width intermediate the maximum and a minimum is indicated in phantom.

FIG. 4 is a section, to an enlarged scale, in the line 4—4 of FIG. 3.

FIG. 5 is an enlarged detail of the plug; and

FIG. 6 is a section showing the tip end portion engaged with the housing and plug in which the end of wall of the plug is indicated as recessed within the housing, in phantom.

DESCRIPTION OF THE PREFERRED EMBODIMENT

With further reference to the drawing, there is illustrated a seal 10, having a shackle portion 11 and a housing 12. The shackle portion includes a strap 13 and an end portion 14, which is receivable within the housing 12. The housing has an axial bore 15 in one end of the housing and an inwardly extending ridge 17 for purposes which will be described.

A series of flexible fingers 16 extend downward and inwardly from an end 18 of the housing. At such end, a socket 20 is provided including a non-circular opening 21 and a recessed seat 22 just above the bore 23.

The wall portion 24 of the housing is of substantially uniform thickness in the upper portion thereof.

In order to close the upper of portion 15 of the housing, there is provided a plug 25 having an end wall 26, an annular groove 27, an annular skirt 28, a tapered reduced end portion 29, and a cavity 30 at its other end. The outer wall 32 of the plug is preferably of slightly greater diameter than the inner wall 15 of the housing in order that substantial force is required to seat or to force the plug within the housing, thereby providing a stronger union between the two. Thus, it will be observed that when the plug is pushed inwardly of the housing, that the end portion 29 and skirt 28 will first engage the ridge 17 of the housing thereby causing the plug to compress inwardly sufficiently for the plug to pass after which the ridge seats tightly within the groove 27 of the plug.

The end wall 26 of the plug is preferably coextensive with the end of the housing 12 or depressed slightly therein in order to avoid providing any protrusion which might be grasped or pried by a tool by someone attempting to open the seal.

At the other end of the shackle, the end portion 14 has a tapered tip 40 which is configured to be received closely within the cavity 30 of the plug. Beneath the tip 40 is a neck portion 42, providing a ledge 43 which when the tip is inserted into the housing, engages the tips of the fingers 16 thereby preventing withdrawal of the tip portion. Next to the neck portion 42 is a non-circular shoulder portion or base 44 having a ledge 45 which engages the socket portion 22 of the housing when the tip is engaged with the housing, thereby closing any possible entryway into the housing.

The strap portion 13, preferably adjacent to the end portion 44, has a non-circular opening 50 which, in the preferred embodiment, is diamond-shaped and provides a zone of weakness in the strap 13. The opening is tapered from top to bottom by the forming die, as indicated in FIG. 4. It will be observed that the width of the border 51 on each side of the diamond-shaped opening 50 determines the strength of the strap at this area. Such width may be varied by merely rotating the die which forms the diamond-shaped opening so that the width 51 may be variably selected in order to permit selection of the breaking strength of the shackle strap. Such breaking strength may be selected for purposes of permitting an authorized person to break the strap as well as to indicate tampering with the strap in the event that excessive force is used in an attempt to surreptitiously remove the strap.

The seal is made of a synthetic, resinous material having some resiliency, as is well-known in the art.

The seal is designed to be manufactured in one piece, except for the plug which is manufactured separately.

It is contemplated that the plug will be manufactured and seated in the housing prior to shipment of the product to the consumer; however, it could be shipped separately if desired.

In the use of the device, the plug is forced into the housing into the seated position as indicated in the drawing. Then when the seal is used, the tip 40 is inserted into the housing past the fingers 16 so that the ledge 43 engages the tips of the fingers thereby preventing withdrawal. At the same time the tip 40 enters the cavity 30 thereby preventing any compression of the plug in an attempt to remove it. Since the plug fits snugly within the housing, it would not be possible to slide a tool past the plug in an effort to manipulate the fingers.

Furthermore, due to the engagement of the shoulder 45 with the socket 20, it is not possible to insert a tool into the housing for the purpose of attempting to manipulate the fingers 16. In addition, since the socket 20 is non-circular, it is not possible to twist or rotate the tip within the housing.

Furthermore, should any excessive force be used past the breaking strength of the strap, it will cause it to rupture, thereby indicating tampering. However, an authorized user may break the strap without requiring any additional tools by the application of such force.

I claim:

1. A resilient seal housing open at both ends and a resilient shackle, said housing and a shackle end having means for locking engagement when the shackle end is inserted into one end of the housing, and means for closing the other end of the housing, comprising a resilient plug having an end wall at one end and having an outer wall of a size to be frictionally received within the housing, said housing having an inwardly extending ridge spaced from said one end and said plug having groove means adapted to receive said ridge and spaced from said end wall of said plug, said plug having a cavity in its other end of a configuration closely to receive the extreme end of said shackle to prevent inward compression of said plug within the portion thereof having said groove means, said plug being entirely received within said housing so that no portion thereof extends outside of said housing.

2. The invention of claim 1, in which the end wall of said plug is recessed within said housing.

3. A seal housing open at both ends and a shackle, said housing and a shackle end having means for locking engagement when the shackle end is inserted into one end of the housing, and means for closing the other end of the housing, comprising a plug having an end wall at one end and having an outer wall of a size to be frictionally received within the housing, said housing having an inwardly extending ridge spaced from said one end and said plug having groove means adapted to receive said ridge and spaced from said end wall of said plug, in which said one end of the housing has a non-circular opening and said shackle end has a base portion of a size and shape to be snugly received within said opening.

4. The invention of claim 1, in which said one end of the housing has a non-circular opening and said shackle end has a base portion of a size and shape to be snugly received within said opening.

5. The invention of claim 3, said shackle having a non-circular opening between its sides.

6. The invention of claim 3, in which said opening is diamond-shaped.

7. The invention of claim 3, in which said non-circular opening is oriented so that the width of the border of the shackle outside of the opening is a maximum.

8. The invention of claim 3, in which said non-circular opening is oriented so that the width of the border of the shackle outside of the opening is a minimum.

9. The invention of claim 3, in which said non-circular opening is oriented so that the width of the border of the shackle outside of the opening is between a minimum and a maximum.

* * * * *